United States Patent [19]

Dyer

[11] 3,989,151

[45] Nov. 2, 1976

[54] GOLF BALL RETRIEVER

[75] Inventor: Curtis P. Dyer, San Francisco, Calif.

[73] Assignee: Lawrence Peska Associates, Inc., New York, N.Y. ; a part interest

[22] Filed: May 2, 1975

[21] Appl. No.: 573,877

[52] U.S. Cl. ..... 214/353; 56/328 R

[51] Int. Cl.[2] ..... B60P 1/00

[58] Field of Search ..... 214/356, 350, 353; 56/328 R

[56] References Cited

UNITED STATES PATENTS

| | | | |
|---|---|---|---|
| 755,452 | 3/1904 | Chelmicki | 214/356 |
| 2,519,136 | 8/1950 | Jochim | 56/328 R |
| 2,729,046 | 1/1956 | Patterson | 214/356 X |
| 2,810,487 | 10/1959 | Bailey | 214/356 |
| 3,010,523 | 11/1961 | Gifford | 56/328 R X |
| 3,593,868 | 7/1971 | Folz | 214/356 |

*Primary Examiner*—Albert J. Makay

[57] ABSTRACT

This disclosure pertains to a golf ball retrieving mechanism detachably mounted to the front of a golf cart having automatic terrain adjusting features which facilitate the removal and retrieval of golf balls without damaging the turf.

1 Claim, 2 Drawing Figures

GOLF BALL RETRIEVER

BACKGROUND OF THE INVENTION

1. The Field of the Invention

This invention relates to the need to recover golf balls on driving ranges and stray balls scattered on the turf of golf courses, utilizing a golf cart.

2. Description of the Prior Art

Tractor like retrievers have been used in the past requiring the user to be content with a fixed angular relationship between the retrieval ramp and the plane of the terrain.

SUMMARY OF THE INVENTION

The instant invention pertains to a golf ball retriever mounted to the front of the golf cart. The retriever has automatic turf configuration compliance in the pickup brush and the ramp utilized to transport the retrieved balls into a storage area.

A primary object of the instant invention is to provide a means to collect golf balls with the aid of a motorized cart.

Another object is to provide a collecting device capable of efficient ball pickup over rough terrain.

Still another object is to provide a pickup brush which is urged into fixed pressure contact with the turf regardless of the slope of the turf.

A further object is to provide a ramp for the balls to roll upon that will not scoop out or mar the turf in use.

Another object is to provide a ramp which is self adjusting in the angle that it makes with the ground, dependent solely on the turf terrain characteristics.

Yet another object is to provide a ramp whose angular relationship with the turf is determined by the vertical displacement of pickup brush.

A further object is to provide a collector utilizing the power imparted to it based solely upon the motion of the cart to which it is affixed.

Still another object is to provide a means to mount the retrieval mechanism preceding the direction in which the golf cart moves, thereby eliminating the crush or burying of the balls under the wheels of the cart.

These objects, as well as other objects of this invention, will become readily apparent after reading the following description of the accompanying drawings.

DESCRIPTION OF THE PREFERRED EMBODIMENTS

The structure and method of fabrication of the present invention is applicable to a retriever fastened pivotably to the front axle of a golf cart used to propel it as the golf cart proceeds in its direction of forward travel. A pickup brush is pivotably mounted in the foremost portion of the retrieval mechanism imparting rearward driving force to any golf balls encountered. The ball is driven up a ramp behind the pickup brush with sufficient force and speed to deposit the ball into a retrieval storage area. The ramp varies in the angular relationship that it makes with the terrain dependent upon the position of the pickup brush in contact with the terrain.

Figure 1:
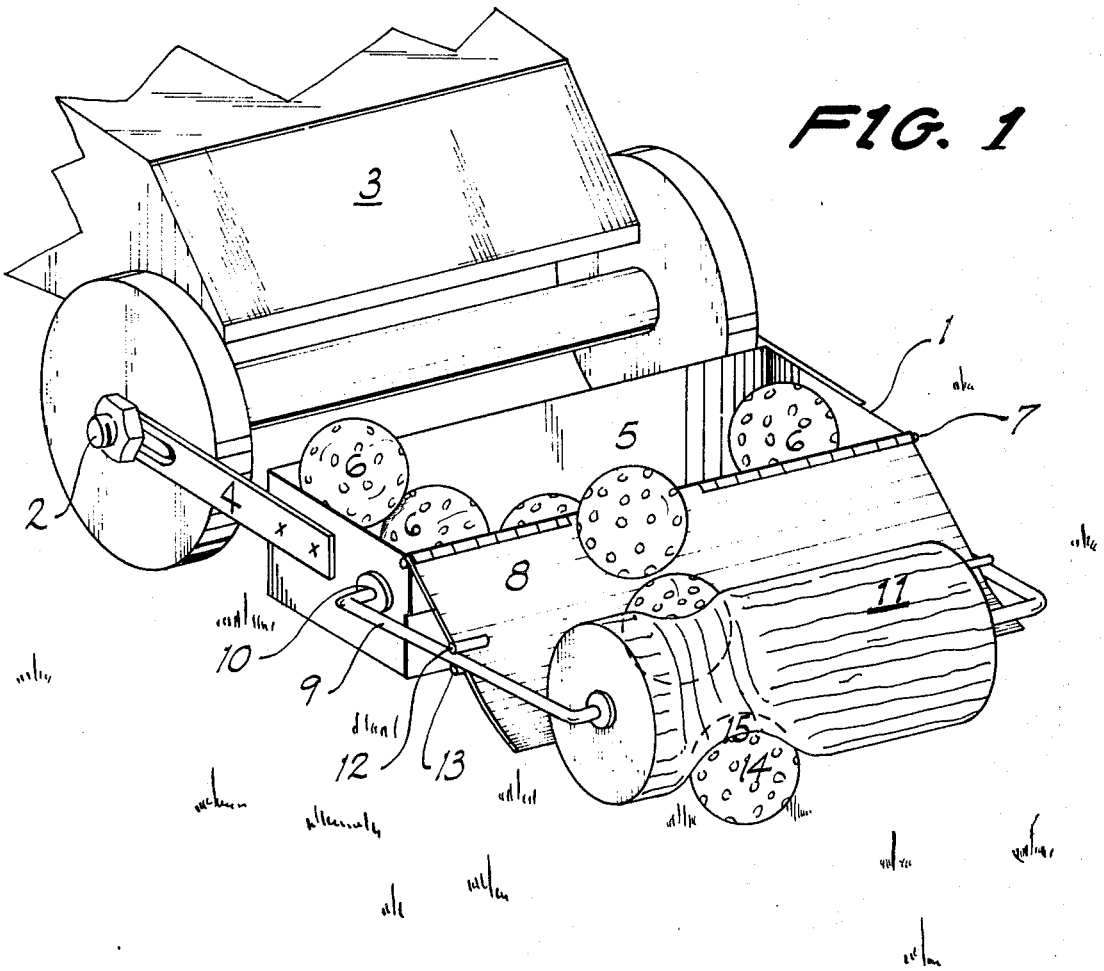
FIG. 1 is a perspective view of the ball retrieval device shown attached to a fragmentary perspective view of the front end of a golf cart.

Now referring to the Figures, and more particularly to the embodiment illustrated in FIG. 1, the golf ball retriever is fastened to the front axle 2 of the golf cart 3. The linkage arm 4 is pivotably connectd at the point where it fastens to the axle 2. The ball storage compartment 5 is illustrated to have capacity to carry stored balls 6. A hinge 7 is fastened to the rearmost side of a ramp 8. The pivot arm 9 is fastened to the walls of the ball storage compartment at a pivot point 10 in such a manner that the pivot arm can rotate freely about the pivot point 10. A compliant cylindrical brush 11 is fastened to the foremost leading end of the pivot arm 9 sensibly placing the axis of the cylindrical brush at right angles to the pivot arm. An upper ramp clamp 12 and lower ramp clamp 13 surround the free side edge of the ramp 8 and are attached along the length of the pivot arm 9. The spacing between the upper clamp 12 and the lower clamp 13 is somewhat larger than the thickness of the ramp 8 permitting the ramp to be loosely engaged by the slot thus formed. An entering golf ball 14 creates depressions 15 due to the compliability of the brush 11 when the ball 14 is encountered between the bottom surface of the brush and the terrain.

Figure 2:
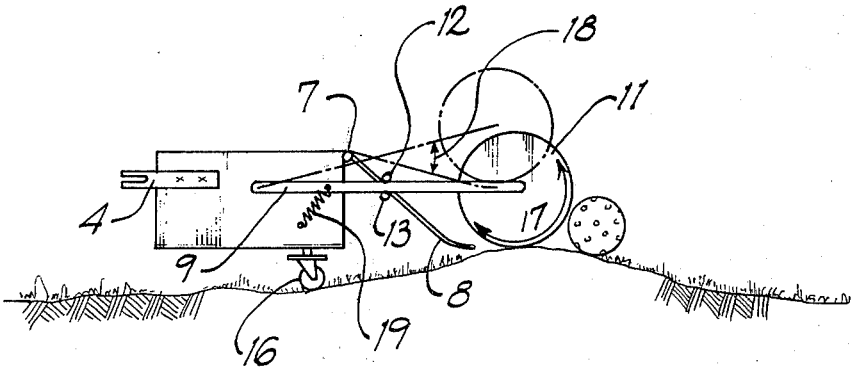
FIG. 2 is a side elevation view of the retrieval mechanism.

FIG. 2 illustrates a side view of the retriever, depicting the brush 11 in contact with the turf 20 beneath it due to the gravitational forces exerted on the brush. Spring 19 is shown to implement the gravitational directed force. The brush 11, the ramp 8, are shown in a displaced position to illustrate the angle assumed by the new angular relationship, the new angle 18 thus formed. Upper and lower ramp clamps 12 and 13 are shown only in the downward most position of the brush. The arrow 17 describes the direction of rotation of the brush 11 as the cart is propelled forward. Since the entire retrieval device precedes the golf cart as it is moved about, the balls will be easily seen and will not be crushed under a swivelable supporting wheel 16 and the wheels of the cart.

One of the advantages is a golf ball retriever powered solely by the forward motion of a golf cart which can pick up balls over rough, variable terrain.

Another advantage is to provide contacting forces between the pickup brush and the turf, sensibly independent of the slope of the turf.

Still another advantage is a retriever device with a ramp leading edge which is adjustable in height over the terrain, precluding a contact with the turf by adjusting the angle that it makes with the ground depending upon the characteristics of the terrain.

Another advantage is a retrieval mechanism affording the maximum visability and having the minimum possibility of forcing a ball, before it is retrieved, into and below the surface of the terrain.

Thus, there is disclosed in the above description and in the drawings embodiments of the invention which fully and effectively accomplish the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

1. A detachable golf cart ball retreiver comprised of a compliant resilient cylindrical brush, the axis of said brush pivotably connected by the end thereof to a ball storage compartment by a pivot arm, a ramp, said ramp hingably fastened to said compartment having an edge in angular relationship articulated by fingers transverse to the length of said pivot arm capturing said ramp edge, said fingers intermediate said brush and the end of said pivot arm pivotably connected to said storage compartment, said brush rotatable about said axis as the cart is propelled, said brush being rotated from the contact of the periphery of said brush with the terrain therebelow, said fingers forming a slot for slidably engaging said ramp edge to said pivot arm intermediate the ends of said pivot arm, said ramp having a variable inclination to the earth automatically varied by said pivot arm in response to the movement of said brush about undulations in the surface of said terrain.

* * * * *